US006055402A

United States Patent [19]

Angst et al.

[11] Patent Number: 6,055,402

[45] Date of Patent: Apr. 25, 2000

[54] SINGLE-COMPONENT DEVELOPING STATION

[75] Inventors: Uwe Angst, Jockgrim; Carsten Schoenfeld, Reilingen; Gerhard Bartscher, Kiel, all of Germany; Steve Cormier, Leominster, Me.; Kenneth D. Fraser, Scarborough, Canada; Anton Rodi, Leimen, Germany

[73] Assignee: Heidelberger Druckmaschinen AG, Heidelberg, Germany

[21] Appl. No.: 09/110,924

[22] Filed: Jul. 6, 1998

[30] Foreign Application Priority Data

Jul. 3, 1997 [DE] Germany ..... 197 28 309

[51] Int. Cl.[7] ..... G03G 15/08

[52] U.S. Cl. ..... 399/279; 399/281; 399/284; 430/120

[58] Field of Search ..... 399/279, 281, 399/284, 285, 265, 266; 430/120, 107, 109, 111

[56] References Cited

U.S. PATENT DOCUMENTS

| | | | |
|---|---|---|---|
| 3,999,515 | 12/1976 | Weiler | 399/285 |
| 4,281,622 | 8/1981 | Kudo et al. | 399/284 |
| 4,378,158 | 3/1983 | Kanbe | 399/281 |
| 4,395,110 | 7/1983 | Hosono et al. | 399/284 |
| 4,624,559 | 11/1986 | Haneda et al. | 399/236 |
| 5,017,967 | 5/1991 | Koga | 399/265 |
| 5,168,312 | 12/1992 | Aoto et al. | 399/284 |
| 5,170,213 | 12/1992 | Yamaguchi et al. | 399/281 |
| 5,412,456 | 5/1995 | Tanuma et al. | 399/284 |
| 5,628,043 | 5/1997 | Ikeda et al. | 399/281 |
| 5,689,784 | 11/1997 | Shin et al. | 399/285 |
| 5,899,608 | 5/1999 | Eklund et al. | 399/266 |

FOREIGN PATENT DOCUMENTS

| | | |
|---|---|---|
| 37 05 469 | 8/1987 | Germany . |
| 56-40860 | 6/1981 | Japan . |
| 59-100470 | 10/1984 | Japan . |
| 60-196785 | 3/1986 | Japan . |

*Primary Examiner*—Sophia S. Chen
*Attorney, Agent, or Firm*—Kenyon & Kenyon

[57] ABSTRACT

A device and a method for developing an electrostatic latent image, which is located on a movable image carrier (1), using a non-conductive single-component toner. The device includes a toner feed device (3), in order to transport toner particles (5) from a toner reservoir (4) and charge them electrically, a rotationally mounted developing roller (2) to receive the charged toner particles from the toner feed device and to transport the toner particles which it holds into a gap between the developing roller and the image carrier, and a rotationally mounted doctor roller (6), which is arranged in the path of the toner particles from the toner feed device to the developing roller, to produce a uniform toner layer with a defined thickness on the developing roller. The surface of the developing roller (2) and the surface of the doctor roller (6) are separated from one another by a gap which is wider than the average diameter of the toner particles (5). In this manner, electrographic printing with high quality and at high speed is made possible.

40 Claims, 2 Drawing Sheets

SINGLE-COMPONENT DEVELOPING STATION

FIELD OF THE INVENTION

The present invention relates to a device and a method for developing an electrostatic latent image which is located on a movable image carrier.

RELATED TECHNOLOGY

High-quality, high-speed electrographic printing is only possible with two-component toner, according to the state of the art. A two-component toner contains toner particles and soft-magnetic carrier particles which are mixed with each other, causing the toner particles to adhere electrostatically to the carrier particles. The carrier particles with the toner particles adhering to them are transported to a developing zone by means of magnetic brushes, where they are transferred to an image carrier in accordance with an electrostatic charge pattern on the image carrier, for example a photoconductor.

On the other hand, single-component toners of non-conductive toner particles have significant advantages as compared with two-component toners. No magnetic brushes and the like are required, so that simple and compact construction of the developing station is possible. In addition, when using single-component toner, the use of carrier particles, which wear over time and must be replaced, is eliminated. For this reason, attempts have been made for a lone time to develop single-component systems with which high printing speeds are possible while achieving flood print quality.

One of the main difficulties in this connection is to produce a uniform layer of toner particles, which must be uniformly charged, to the extent this is possible, on a developing roller, also called ink application roller. Some commercially utilized systems use a regenerating roller made of a foam-like material, which transports toner particles from a toner reservoir to the developing roller. Because of the resulting friction, the toner particles are electrically charged, causing, them to adhere to the electrically conductive developing roller, in a layer with treater or lesser thickness. In order to make this layer more uniform, fixed blades have been used, which strip excess toner from the developing roller. There are systems with a hard developing roller, for example made of aluminum or steel, and a rubber lip as a blade, but also systems with a hard blade made of metal and a developing roller made of a rubber material.

In both of the systems mentioned above, there is a defined contact pressure between the blade and the developing roller, which results in gravity forces on the toner, loners with a relatively low melting point are desired for the fixation process, and they therefore have relatively elastic toner particles. Such toner particles are slightly deformed by the forces at the gap between the blade and the developing roller, and heat is generated. At higher speeds of the developing roller, so much heat is produced that the toner can start to melt in certain spots. Once a defect has been formed, it continues along the circumference of the developing roller and tends to grow. This process, which is called filming or smearing, limits the printing speeds which can be achieved with such a system, typically to speeds below 15 cm/s. In addition, there are clear quality defects, for example in comparison with offset printing.

U.S. Pat. No. 4,876,575 proposes using a metal rod or metallized plastic rod which can rotate along its axis, and which is elastically pressed against the rigid developing roller, for metering and uniform charging of the toner layer on the developing roller. The metal rod forms a doctor roller which is supposed to leave precisely one layer of toner particles on the developing roller. A similar system is described in U.S. Pat. No. 5,128,723. However, because of the elastic suspension of the doctor roller, which constantly presses against the developing roller, relatively large forces are exerted on the toner particles in these systems as well, and therefore the printing speed at which no smearing occurs is still limited to relatively low values.

SUMMARY OF THE INVENTION

The present invention is based on the task of creating a single-component development technique which is suitable for electrographic printing at high speed and with high quality.

To accomplish this task, the present invention proceeds from a device for developing an electrostatically latent image, which is located on a movable image carrier, using a non-conductive single-component toner. The device includes the following: a toner feed device to transport toner particles from a toner reservoir and charge them electrically, a rotationally mounted developing roller to receive the charged toner particles from the toner feed device and to transport the toner particles which it holds into a gap between the developing roller and the image carrier, and a rotationally mounted doctor roller, which is arranged in the path of the toner particles from the toner feed device to the developing roller, to produce a uniform toner layer with a defined thickness on the developing roller. According to the present invention, the surface of the developing roller and the surface of the doctor roller are separated from one another by a gap which is wider than the average diameter of the toner particles.

A corresponding method for developing an electrostatic latent image, which has been produced on a movable image carrier, using a non-conductive single-component toner, includes charging toner particles electrically and transporting them to the surface of a rotating developing roller to which they adhere electrostatically, allowing the surface of the developing roller with the toner particles adhering to it to go past a rotating doctor roller, in order to produce a uniform toner layer with a defined thickness on the developing roller, and transporting the toner particles into a gap between the developing roller and the image carrier, in which they are transferred to the image carrier, characterized in that a fixed distance is set between the surface of the developing roller and the surface of the doctor roller, which is greater than the average diameter of the toner particles.

While it is typically assumed, in the state of the art, that the blade or doctor roller presses elastically against the developing roller, according to the present invention a gap is provided between the doctor roller and the developing roller, for example by mounting a rigid developing roller and a rigid doctor roller in fixed points of rotation on a printing machine. Surprisingly, it has been shown that in this manner, significantly higher printing speeds can be achieved than with any other one of the systems described above, without any smearing occurring, and without any deterioration in the print quality. Printing speeds of more than 50 cm/s using a toner with a low melting point may he achieved.

A possible explanation for the fact that the toner according to the present invention does not start to melt until significantly greater speeds than in the state of the art is the following. A suitable selection of materials and speeds of the toner feed device ensures that the toner particles which are transported into the zone in front of the gap are predominantly charged with the same polarity. The repulsion between like charges then ensures that only a limited number of toner particles gets into the gap, so that the toner particles in the gap are subject to relatively little mechanical stress. In the build-up zone in front of the gap, the toner particles move essentially without friction, because of their mutual repulsion, and excess toner is rejected due to the electrical field formed in the build-up zone, and drops back into the toner reservoir.

However, it is difficult to achieve a completely uniform charge of the toner particles by friction electricity, as it is used in the preferred embodiment of the present invention. On the other hand, it is desirable for good print quality to provide the developing roller with toner particles that have as precisely defined a charge as possible. As will still be described below, a further development of the present invention makes it possible to subsequently charge toner particles which have an undesirable charge, and pass through the gap between the developing roller and the doctor roller, to the desired potential, so that the toner particles all carry a defined charge when they reach the image carrier.

In the preferred embodiment, the developing roller and the doctor roller are allowed to turn in the same direction of rotation, so that their surfaces move counter to one another, with the speeds of rotation in each instance being adjusted in such a way that the surface speed of the doctor roller is significantly less than the surface speed of the developing roller. The doctor roller can turn either continuously or in small steps. With more or less long stopping times between two rotation movements.

Since the doctor roller constantly offers a different surface to the toner particles, there is no excessive spot heating in the build-up zone which could cause the toner particles to start to melt. Since the toner particles stay in the build-up zone only for a relatively short period of time, and since the surface offered to them is constantly renewed, it is also not harmful if the doctor roller becomes relatively warm during operation. The precise value of the speed of rotation of the doctor roller is not critical. Under some circumstances, the doctor roller can also be allowed to rotate in the opposite direction of rotation of the developing roller, i.e. so that their surfaces move in the same direction in the gap. However, there are indications that higher speeds of rotation of the doctor roller tend to be disadvantageous.

In a preferred embodiment, the width of the gap between the surface of the developing roller and the surface of the doctor roller is at least twice the average diameter of the toner particles, the toner layer on the developing roller passing through the gap being composed of approximately one to two layers of toner particles.

Specifically, the average diameter of the toner particles can be approximately 5 to 15 $\mu$m, it being possible for the width of the gap between the surface of the developing roller and the surface of the doctor roller to be approximately 15 to 50 $\mu$m. However, with single-component systems, the present invention can also be used with much finer toner.

A correspondingly narrower gap between the developing roller and the doctor roller sets high requirements with regard to the evenness and true running of the rollers. The further developments of the present invention described below make it possible to use a gap with a width which is many times the average diameter of the toner particles, while nevertheless obtaining a toner layer composed of only one layer or only a few layers on the developing roller. In addition, these further developments make it possible to obtain a particularly uniform toner layer.

If the doctor roller, just as the developing roller, is electrically conductive, a defined electrical potential difference can be produced between them. If a direct voltage is used, with which the polarity of the charge of the doctor roller is made to be opposite that of the toner particles, the layer thickness of the toner particles on the developing roller is reduced. The direct voltage can lie in the range of 50 to 1000 volts, for example. In this manner, a gap can be used which is significantly wider than the average diameter of the toner particles, for example 100 $\mu$m with a toner particle diameter of 10 $\mu$m.

The electrical voltage between the doctor roller and the developing roller can also be an alternating voltage, which has an amplitude between ±50 and ±1000 volts and a frequency between 200 and 50,000 hertz, for example. Also, a direct voltage can be used which has such an alternating voltage superimposed on it.

Another measure to produce both a uniform and a thin toner layer with as wide as possible a gap between the doctor roller and the developing roller is to provide several doctor rollers, one after the other, the width of the gap between the surface of the developing roller and the surfaces of the doctor rollers either being the same for all the doctor rollers, or becoming smaller from doctor roller to doctor roller. In both cases, the toner layer becomes thinner from doctor roller to doctor roller.

With the measures described above, or with a suitable combination of these measures, it is possible to produce a thin and uniform toner layer on the developing roller, even with a gap width of 200 or 500 $\mu$m, for example which can be implemented relatively easily in technical terms.

In a preferred embodiment, both the developing roller and the doctor roller have a rigid metal body with a hard, wear-resistant surface. In this manner, a high level of precision in terms of evenness and true running of the developing roller and the doctor roller can be most easily achieved. In addition, the metal rollers guarantee that the charge which occurs when charging, the toner particles can be dissipated again, so that charging of the subsequent toner particles can proceed without problems.

Transfer of the toner particles from the developing roller to the image carrier can take place either via a gap between the image carrier and the developing, roller, across which the toner particles jump (this technique is called gap developing), or in that the developing roller touches the image carrier (this technique is called contact developing). In addition, intermediate forms of these developing techniques are possible.

An image carrier in the form of a cylinder, for example a photoconductive drum or a drum with a large number of microcells isolated from one another, which can be individually charged by processor control, generally has a rigid structure, for technical reasons. In order to be able to perform contact developing, the high requirements with regard to evenness and true running of a rigid developing roller and a rigid doctor roller would also have to be met by the image cylinder. In order to avoid this, in a preferred embodiment of the present invention, the doctor roller has a rigid metal body, and the developing roller has a cylindrical, foam-like core with a hollow cylinder sleeve made of a solid material. The sleeve of the developing roller can be made of metal, or it can be made of a plastic which is provided with a hard, wear-resistant surface on the outside. If the plastic or the wear-resistant surface is not conductive on its own, an additional conductive layer can be provided in between, if necessary.

Such a flexible developing roller is able to form an intimate contact with the image cylinder for contact developing. Because of the layer structure of the developing roller, it is possible to ensure that it is both elastic and has suitable inherent damping, so that the surface of the developing roller which is pressed into the image cylinder will reach its precise rest position again before passing by the doctor roller. The relatively rigid sleeve guarantees that this rest position is precisely defined. In this manner, a precisely defined gap between the developing roller and the doctor roller can be maintained even with a flexible developing roller, and smearing is avoided even at high speeds.

Instead of a cylindrical image carrier, an endless web which runs around several rotating rollers can also be used. If contact developing is used, a rigid developing roller can then he used, with the image carrier web elastically making intimate contact with it.

As was mentioned, in the preferred embodiment, the toner particles transported to the developing roller are charged by friction electricity which is, for example, produced by a regenerating roller made of a foam-like material, a simple method. The charge of the toner particles can be controlled, within certain limits, by the materials and speeds used.

In case the charges of the toner particles transported to the developing roller nevertheless vary too greatly or if there are actually toner particles with opposite charges among them, in a further development of the present invention, a charge-carrier generator is provided which is adjacent to the developing roller on the path of the toner particles from the doctor roller to the image carrier. Alternatively, the charge carrier generator can be adjacent to the developing roller in the path of the toner particles from the toner feed device to the doctor roller. The charge carrier generator is particularly an ion source and can specifically be a Corotron or a Scorotron, which radiates onto the surface of the developing roller. A plasma generator also may be used, with which the required ion streams can be more easily produced. The charges of the toner particles on the developing roller are made more uniform by the ion bombardment.

In order to free the doctor roller of toner which adheres to the doctor roller after excess toner is stripped from the developing roller, a conventional elastic stripping blade can be used.

The term "non-conductive" is defined by the time progression of the developing process and/or subsequent processes. Within these characteristic times, an electrical charge on the toner particles is allowed to flow off only to a slight degree, a charge drain can be estimated via the time constant $\tau$ of the material:

$$\tau=\epsilon\rho$$

where $\epsilon$ represents the dielectricity constant and $\rho$ represents the specific conductivity of the material. An example: with a roller diameter of 4 cm for the developing roller and a surface speed of 50 cm/s, half a rotation takes about 0.12 s. Assuming that approximately half a rotation elapses between charging of the particles and the developing process, then the aforementioned 0.12 s are a characteristic time. With a typical value of $\epsilon=2\cdot10^{-11}$ F/m, $\rho<1.7\cdot10^{-10}$ $\Omega$m.

DETAILED DESCRIPTION

Figure 1:
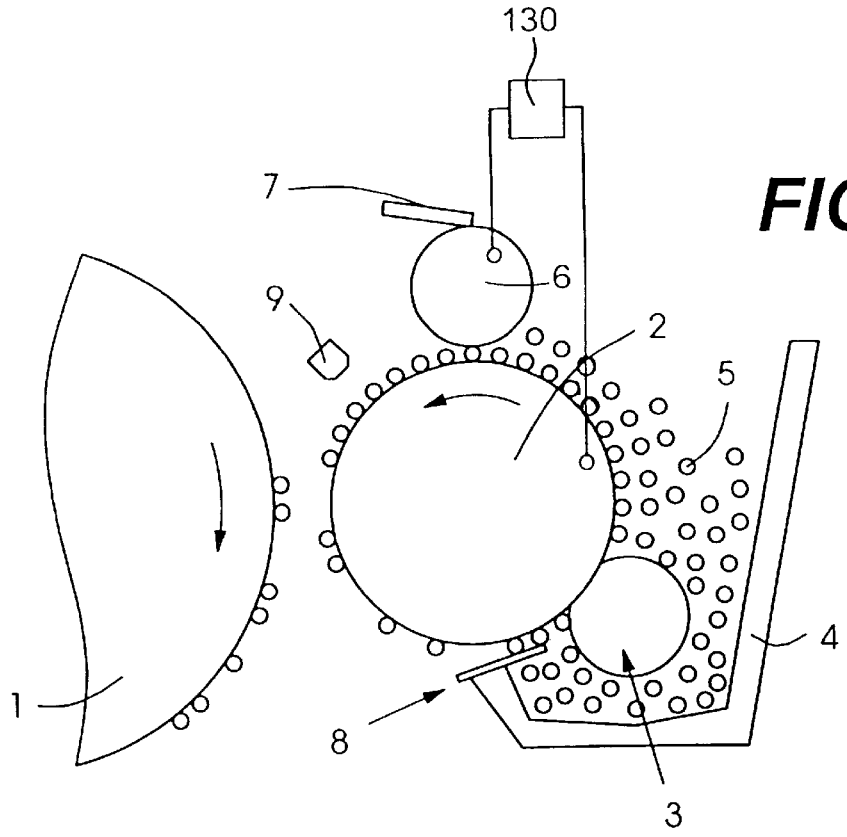
FIG. 1 shows a cross-sectional view of a developing station for gap development.

FIG. 1 shows a developing station or an ink unit for a printing machine, for development of an electrostatic charge pattern on a rotating, rigid image cylinder 1 of the printing machine. A rotating rigid developing roller 2 is mounted axially parallel to the image cylinder 1. Developing roller 2 is made of metal, typically steel, with a wear-resistant outer coating. A rotating regenerating roller 3, which is made of a foam-like material, is mounted axially parallel to developing roller 2. Regenerating roller 3 is connected, first of all, with a toner reservoir 4, in which it is densely surrounded by toner particles 5, and second of all, it presses against developing roller 2, causing regenerating roller 3 to be compressed at the contact point.

Above developing roller 2, at a very small distance from developing roller 2, a rotating, rigid doctor roller 6 made of metal is mounted axially parallel. Doctor roller 6 also has a wear-resistant surface. The gap between the surfaces of developing roller 2 and doctor roller 6 is slightly greater than the diameter of the toner particles 5 (which are shown with extreme magnification in the drawing). Above doctor roller 6, a rubber blade 7 is arranged, which presses resiliently against doctor roller 6. Between toner reservoir 4 and developing roller 2, a sealing lip 8 is also affixed, in order to prevent toner particles 5 from exiting out of toner reservoir 4 at this location. A voltage source 130 provides electrical voltage between the doctor roller 6 and the developing roller 2.

In operation, image cylinder 1, developing roller 2, regenerating roller 3, and doctor roller 6 are rotated in the directions shown with arrows in the figure, image cylinder 1 and developing roller 2 rotating at the same circumference speed, and doctor roller 6 rotating at a significantly lower circumference speed than developing roller 2.

Toner particles 5, which are non-conductive discrete particles with a typical size of approximately 5 to 15 $\mu$m, are electrically neutral, to a great extent, within toner reservoir 4. Toner particles 5 are transported to developing roller 2 by rotating regenerating roller 3, and electrostatically charged by the resulting friction. Because of the electrical charge, toner particles 5 adhere to electrically conductive developing roller 2, via mirror charges.

Developing roller 2 transports toner particles 5 upward, in several layers, to doctor roller 6. There only a limited number of toner particles 5 can pass through the narrow gap between developing roller 2 and doctor roller 6. In FIG. 1, the gap is shown as being only slightly wider than the diameter of the toner particles, and exactly one layer of toner particles 5 passes through the gap between developing roller 2 and doctor roller 6. Because of the electrical field which toner particles 5 that are transported into the build-up zone in front of the gap produce, excess toner particles 5 are rejected and drop back into toner reservoir 4. Therefore the build-up zone in which toner particles 5 collect in front of the gap does not grow in uncontrolled manner, but rather takes on a stable state in terms of size.

Toner particles 5 which have passed through the gap between developing roller 2 and doctor roller 6 are then drawn into the actual developing region, where toner particles 5 are attracted by the charged image regions of image cylinder 1. Developing can take place via contact with image cylinder 1 or via a gap between image cylinder 1 and developing roller 2. In FIG. 1, gap developing is shown.

A gap with a width of approximately 30 $\mu$m may be set between developing roller 2 and doctor roller 6, with between one and two mono-layers of toner particles 5 still being located on developing roller 2 behind doctor roller 6. While some friction may occur during the stripping process, resulting in further advantageous charging of the toner particles, it is not, however, so much friction that the toner starts to melt and smear on developing roller 2. Rather, at up to print speeds of 50 cm/s, a high level of long-term stability may be achieved, with very good print quality.

By varying the width of the gap between developing roller 2 and doctor roller 6, the thickness of the toner layer which is allowed to pass through the gap can be adjusted. This does not cause the reliability of smear prevention to deteriorate, as long as no significant pressure is exerted, which toner particles 5 are not able to escape, i.e. as long as the (gap between developing roller 2 and doctor roller 6 is not less than the particle diameter. With increasing pressure of doctor roller 6 on developing roller 2, the printing speed which may be achieved without smearing may deteriorate to approximately 15 cm/s.

Changes in the speed of rotation or also the direction of rotation of the doctor roller had lesser effect. It is important that doctor roller 6 does turn a little, because smearing may occur when doctor roller 6 is standing still. The best results may be obtained when doctor roller 6 rotated relatively slowly and counter to developing roller 2.

In order to obtain a uniform charge of toner particles 5 which have passed through the gap between developing roller 2 and doctor roller 6, it is advantageous to arrange a charge carrier generator 9 in the path of toner particles 5 from doctor roller 6 to image cylinder 1, which radiates onto developing roller 2. If the toner layer produced on the developing roller by the regenerating roller is not too thick, charge carrier generator 9 can also be arranged in front of doctor roller 6, i.e. in the path of toner particles 5 from regenerating roller 3 to doctor roller 6.

Charge carrier generator 9 can be a Corotron, for example. A Scorotron, which has a maximum potential to which toner particles 5 can be charged, is more suitable.

Alternatively, a plasma generator, for example, can be used as charge-carrier generator 9, which produces a plasma in the vicinity of the surface of developing roller 2. With such a plasma generator, greater amounts of charge can easily be produced, as they are required at high printing speeds. However, the plasma is not allowed to be so dense that toner particles 5 start to melt.

Figure 2:
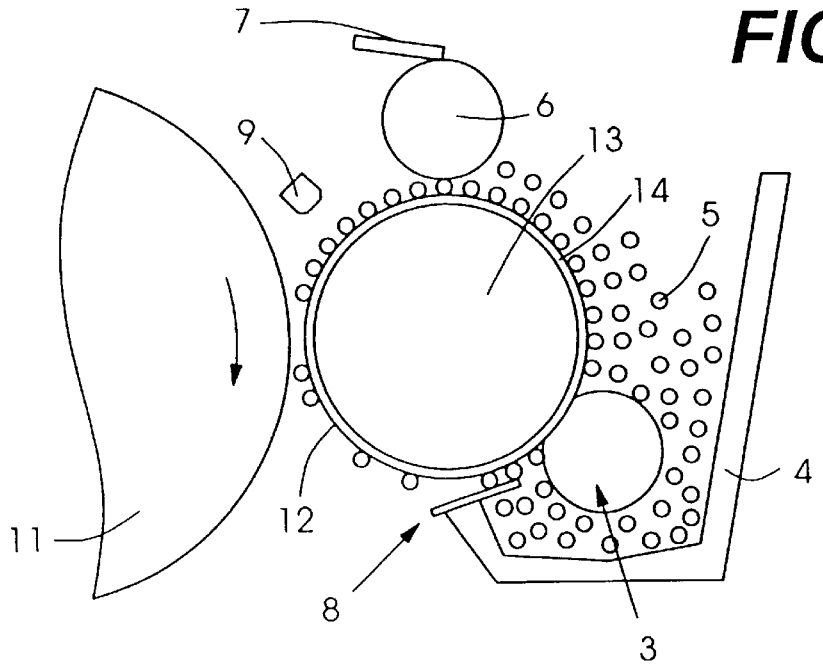
FIG. 2 shows a cross-sectional view of a developing station for contact development.

FIG. 2 shows a cross-sectional view of a developing station for contact development. Components in FIG. 2 which agree with the embodiment of FIG. 1 are indicated with the same reference numbers, and only the components which are different will be described below.

In FIG. 2 an image cylinder 11 is arranged directly on a developing roller 12, as is necessary for contact developing. In order to even out lack of precision in the true running of image cylinder 11, a developing roller 12 which is inherently elastic is used. Image cylinder 11 and developing roller 12 roll against one another under slight pressure, causing developing roller 12 to be compressed slightly at the contact point (not evident in the figure).

Developing roller 11 has a cylindrical core 13 made of an elastic foam material, with a hollow cylindrical sleeve 14 made of metal, which can additionally be hardened at its surface. The thickness and the strength of hollow cylindrical sleeve 14, as well as the type of foam material, are selected in such a way that while developing roller 12 gives way at the contact point with image cylinder 11, the deformation caused by this is eliminated so quickly that developing roller 12 has reached its reference radius again no later than when it reaches doctor roller 6. This is possible, since elastic foam materials have a relatively high level of inherent damping.

Alternatively, the hollow cylindrical sleeve of developing roller 12 can also be made of a suitable plastic, which is provided with a hard, wear-resistant layer on the outside, for example a metallization. In order to be able to achieve high printing speeds, it must then be ensured, in suitable manner, that charges can dissipate from the metallization. e.g. to the ground.

Figure 3:
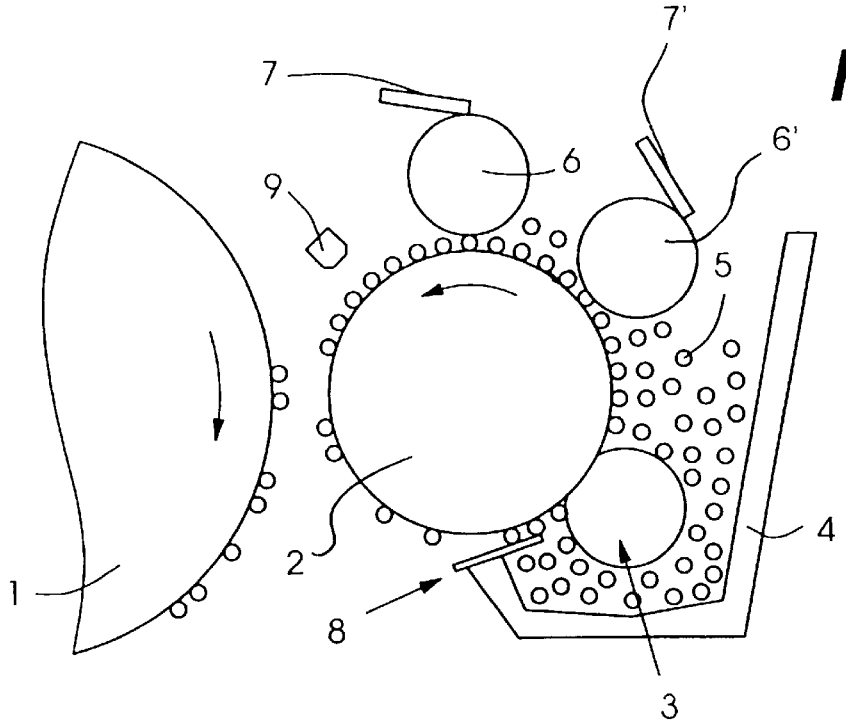
FIG. 3 shows a cross-sectional view of a developing station according to a third embodiment of the invention.

FIG. 3 shows a third embodiment of the invention, where an additional doctor roller 6' with a blade 7' is arranged about the circumference of developing roller 2.

Figure 4:
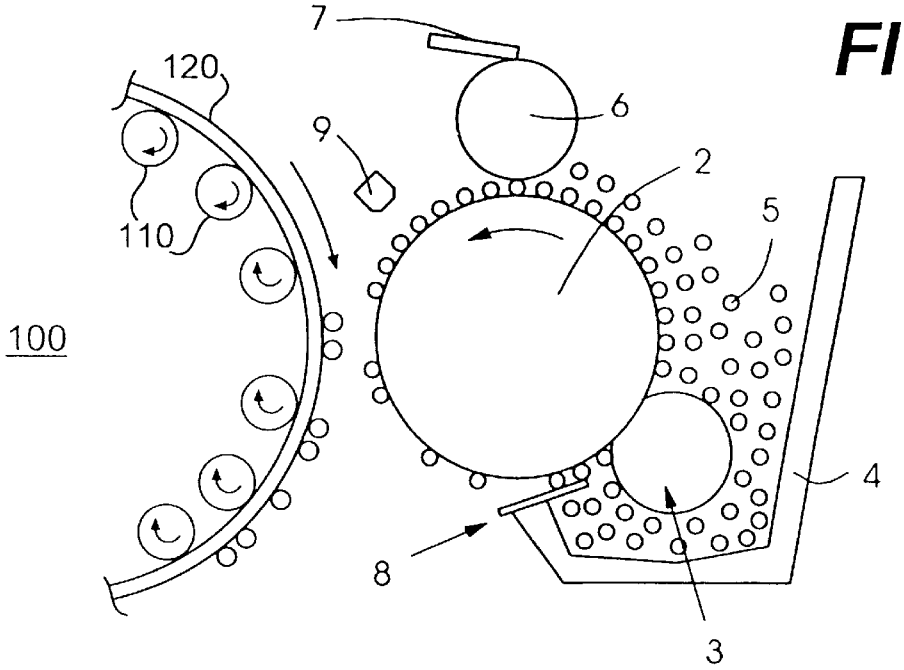
FIG. 4 shows a cross-sectional view of a developing station according to a fourth embodiment of the invention.

FIG. 4 shows a fourth embodiment of the invention, where an image carrier 100 is an endless belt 120 running around rotating cylinders 110.

What is claimed is:

1. A device for developing an electrostatic latent image located on a movable image carrier using al non-conductive single-component toner, the device comprising:

a toner feed device for transporting toner particles from a toner reservoir and charging them electrically, the toner particles having an average diameter of between about 5 and 15 $\mu$m;

a rotationally-mounted developing roller having a developing roller surface, the developing roller for receiving the charged toner particles from the toner feed device and for transporting the toner particles into a first gap between the developing roller and the image carrier; and a rotationally-mounted doctor roller having a doctor roller surface, the doctor roller arranged in the path of the toner particles from the toner feed device to the developing roller, the doctor roller for producing a uniform toner layer with a defined thickness on the developing roller, the developing roller surface and the doctor roller surface being separated from one another by a second gap, the second gap being wider than an average diameter of the toner particles and having a dimension of between about 15 and 50 $\mu$m.

2. The device as recited in claim 1 wherein a width of the second gap is at least twice the average diameter of the toner particles, and that the toner layer on the developing roller passing through the second gap is composed of approximately one to two layers of toner particles.

3. The device as recited in claim 1 wherein an electrical voltage is applied between the doctor roller and the developing roller.

4. The device as recited in claim 3 wherein the electrical Voltage is a direct voltage.

5. The device as recited in claim 3 wherein the electrical voltage is an alternating voltage.

6. The device as recited in claim 3 wherein the electrical voltage is a direct voltage with a superimposed alternating voltage.

7. The device as recited in claim 1 further comprising at least one additional doctor roller arranged about a circumference of the developing roller.

8. The device as recited in claim 7 wherein the at least one additional doctor roller forms a third gap between the additional doctor roller and the developing roller, a width of the second and third gaps becoming smaller in a transport direction of the toner particles.

9. The device as recited in claim 1 further comprising a charge-carrier generator adjacent to the developing roller in a path of the toner particles from the toner feed device to the image carrier.

10. The device as recited in claim 9 wherein the charge-carrier generator is a Scorotron, which radiates onto the developing roller surface.

11. The device as recited in claim 9 wherein the charge-carrier generator is an ion source.

12. The device as recited in claim 9 wherein the charge-carrier generator is a plasma generator.

13. The device as recited in claim 1 further comprising an elastic stripping blade arranged at a location on a circumference of the doctor roller to strip off toner.

14. The device as recited in claim 1 wherein the image carrier is a rotating cylinder or an endless belt which runs around rotating cylinders.

15. A device for developing an electrostatic latent image located on a movable image carrier using a non-conductive single-component toner, the device comprising:

a toner feed device for transporting toner particles from a toner reservoir and charging them electrically;

a rotationally-mounted developing roller having a developing roller surface, the developing roller for receiving the charged toner particles from the toner feed device and for transporting the toner particles into a first gap between the developing roller and the image carrier;

a rotationally-mounted doctor roller having a doctor roller surface, the doctor roller arranged in the path of the toner particles from the toner feed device to the developing roller, the doctor roller for producing a uniform toner layer with a defined thickness on the developing roller, the developing roller surface and the doctor roller surface being separated from one another by a second gap, the second gap being wider than an average diameter of the toner particles; and at least one additional doctor roller that forms a third gap between the additional doctor roller and the developing roller, a width of the second gap and the third gap being the same.

16. A device for developing an electrostatic latent image located on a movable image carrier using a non-conductive single-component toner, the device comprising:

a toner feed device for transporting toner particles from a toner reservoir and charging them electrically;

a rotationally-mounted developing roller having a developing roller surface, the developing roller for receiving the charged toner particles from the toner feed device and for transporting the toner particles into a first gap between the developing roller and the image carrier; and a rotationally-mounted doctor roller having a doctor roller surface, the doctor roller arranged in the path of the toner particles from the toner feed device to the developing roller, the doctor roller for producing a uniform toner layer with a defined thickness on the developing roller, the developing roller surface and the doctor roller surface being separated from one another by a second gap, the second gap being wider than an average diameter of the toner particles, wherein both the developing roller and the doctor roller have a hard, wear-resistant surface.

17. A device for developing an electrostatic latent image located on a movable image carrier using a non-conductive single-component toner, the device comprising:

a toner feed device for transporting toner particles from a toner reservoir and charging them electrically;

a rotationally-mounted developing roller having a developing roller surface, the developing roller for receiving the charged toner particles from the toner feed device and for transporting the toner particles into a first gap between the developing roller and the image carrier; and a rotationally-mounted doctor roller having a doctor roller surface, the doctor roller arranged in the path of the toner particles from the toner feed device to the developing roller, the doctor roller for producing a uniform toner layer with a defined thickness on the developing roller, the developing roller surface and the doctor roller surface being separated from one another by a second gap, the second gap being wider than an average diameter of the toner particles, wherein both the developing roller and the doctor roller have a rigid metal body.

18. A device for developing an electrostatic latent image located on a movable image carrier using a non-conductive single-component toner, the device comprising:

a toner feed device for transporting toner particles from a toner reservoir and charging them electrically;

a rotationally-mounted developing roller having a developing roller surface, the developing roller for receiving the charged toner particles from the toner feed device and for transporting the toner particles into a first gap between the developing roller and the image carrier; and a rotationally-mounted doctor roller having a doctor roller surface, the doctor roller arranged in the path of the toner particles from the toner feed device to the developing roller, the doctor roller for producing a uniform toner layer with a defined thickness on the developing roller, the developing roller surface and the doctor roller surface being separated from one another by a second gap, the second gap being wider than an average diameter of the toner particles, wherein the doctor roller has a rigid metal body, and the developing roller has a cylindrical, foam-like core with a hollow cylindrical sleeve made of a solid material.

19. The device as recited in claim 18 wherein the hollow cylindrical sleeve is made of metal.

20. The device as recited in claim 18 wherein the hollow cylindrical sleeve is made of plastic, a hard, wear-resistant surface being located on an outside of the hollow cylindrical sleeve.

21. A device for developing an electrostatic latent image located on a movable image carrier using a non-conductive single-component toner, the device comprising:

a toner feed device for transporting toner particles from a toner reservoir and charging them electrically;

a rotationally-mounted developing roller having a developing roller surface, the developing roller for receiving the charged toner particles from the toner feed device and for transporting the toner particles into a first gap between the developing roller and the image carrier; and a rotationally-mounted doctor roller having a doctor roller surface, the doctor roller arranged in the path of the toner particles from the toner feed device to the developing roller, the doctor roller for producing a uniform toner layer with a defined thickness on the developing roller, the developing roller surface and the doctor roller surface being separated from one another by a second gap, the second gap being wider than an average diameter of the toner particles, wherein the toner feed device is a rotationally mounted regenerating roller made of a foam-like material, the toner feed device contacting the developing roller with pressure and being at least partially surrounded by the toner in the toner reservoir.

22. A method for developing an electrostatic latent image produced on a movable image carrier using a non-conductive single-component toner, the method comprising:

charging toner particles having an average diameter of between about 5 and 15 $\mu$m electrically;

transporting toner particles to a surface of a rotating developing roller, the toner particles adhering electrostatically on the surface;

passing the surface of the developing roller with the toner particles by a rotating doctor roller in order to produce a uniform toner layer with a defined thickness on the developing roller, and transporting the toner particles into a first gap between the developing roller and the image carrier for transfer to the image carrier, a fixed distance of between about 15 and 50 $\mu$m being set between the surface of the developing roller and a surface of the doctor roller, the fixed distance being greater than an average diameter of the toner particles.

23. The method as recited in claim 22 wherein the doctor roller is rotated either continuously or in steps.

24. The method as recited in claim 22 wherein the toner particles transported onto the surface of the developing roller are predominantly charged with the same polarity.

25. The method as recited in claim 24 wherein the toner particles are charged by static electricity.

26. The method as recited in claim 22 wherein the fixed distance is at least twice the average diameter of the toner particles, and that the toner layer on the developing roller is composed of approximately one to two layers of toner particles after going past the doctor roller.

27. The method as recited in claim 22 further comprising applying an electrical charge between the doctor roller and the developing roller.

28. The method as recited in claim 27 wherein the electrical voltage is a direct voltage.

29. The method as recited in claim 27 wherein the electrical voltage is an alternating voltage.

30. The method as recited in claim 27 wherein the electrical voltage is a direct voltage with a superimposed alternating voltage.

31. The method as recited in claim 22 further comprising stripping off the toner particles adhering to the doctor roller by using an elastic stripping blade.

32. The method as recited in claim 28 wherein a charge of the toner particles on a path from the doctor roller to the image carrier is uniform.

33. The method as recited in claim 32 wherein the charge of the toner particles is made uniform by a Scorotron which radiates onto the surface of the developing roller.

34. The method as recited in claim 32 wherein the charge of the toner particles is made uniform by a plasma generator.

35. A method for developing an electrostatic latent image produced on a movable image carrier using a non-conductive single-component toner, the method comprising:

charging toner particles electrically;

transporting toner particles to a surface of a rotating developing roller, the toner particles adhering electrostatically on the surface;

passing the surface of the developing roller with the toner particles by a rotating doctor roller in order to produce a uniform toner layer with a defined thickness on the developing roller, and transporting the toner particles into a first gap between the developing roller and the image carrier for transfer to the image carrier, a fixed distance being set between the surface of the developing roller and a surface of the doctor roller, the fixed distance being greater than an average diameter of the toner particles, wherein the developing roller and the doctor roller are allowed to turn in the same direction of rotation, so that their surfaces move counter to one another, speeds of rotation of the developing roller and the doctor roller being adjusted so that a surface speed of the doctor roller is significantly less than a surface speed of the developing roller.

36. A method for developing an electrostatic latent image produced on a movable image carrier using a non-conductive single-component toner, the method comprising:

charging toner particles electrically;

transporting toner particles to a surface of a rotating developing roller, the toner particles adhering electrostatically on the surface;

passing the surface of the developing roller with the toner particles by a rotating doctor roller in order to produce a uniform toner layer with a defined thickness on the developing roller, and transporting the toner particles into a first gap between the developing roller and the image carrier for transfer to the image carrier, a fixed distance being set between the surface of the developing roller and a surface of the doctor roller, the fixed distance being greater than an average diameter of the toner particles, wherein both the developing roller and the doctor roller are provided with a hard, wear-resistant surface.

37. A method for developing an electrostatic latent image produced on a movable image carrier using a non-conductive single-component toner, the method comprising:

charging toner particles electrically;

transporting toner particles to a surface of a rotating developing roller, the toner particles adhering electrostatically on the surface;

passing the surface of the developing roller with the toner particles by a rotating doctor roller in order to produce a uniform toner layer with a defined thickness on the developing roller, and transporting the toner particles into a first gap between the developing roller and the image carrier for transfer to the image carrier, a fixed distance being set between the surface of the developing roller and a surface of the doctor roller, the fixed distance being greater than an average diameter of the toner particles, wherein the developing roller and the doctor roller are formed with a rigid metal body.

38. A method for developing an electrostatic latent image produced on a movable image carrier using a non-conductive single-component toner, the method comprising:

charging toner particles electrically;

transporting toner particles to a surface of a rotating developing roller, the toner particles adhering electrostatically on the surface;

passing the surface of the developing roller with the toner particles by a rotating doctor roller in order to produce a uniform toner layer with a defined thickness on the developing roller, and transporting the toner particles into a first gap between the developing roller and the image carrier for transfer to the image carrier, a fixed distance being set between the surface of the developing roller and a surface of the doctor roller, the fixed distance being greater than an average diameter of the toner particles, wherein the doctor roller has a rigid metal body, and the developing roller has a cylindrical, foam-like core with a hollow cylindrical sleeve made of a solid material.

39. The method as recited in claim 38 wherein the hollow cylinder sleeve is made of metal.

40. The method as recited in claim 38 wherein the hollow cylindrical sleeve is made of plastic, a hard, wear-resistant surface being formed on an outside of the hollow cylindrical sleeve.

* * * * *